US006264420B1

(12) United States Patent
Bieringer et al.

(10) Patent No.: US 6,264,420 B1
(45) Date of Patent: Jul. 24, 2001

(54) DEVICE FOR MONITORING SHEETS

(75) Inventors: Arne Bieringer, Mering; Ernst-Norbent Krause, Sulzemoos, both of (DE)

(73) Assignee: Louda Systems GmbH, Gersthofen (DE)

( * ) Notice: Subject to any disclaimer, the term of this patent is extended or adjusted under 35 U.S.C. 154(b) by 0 days.

(21) Appl. No.: 09/423,978

(22) PCT Filed: Mar. 13, 1999

(86) PCT No.: PCT/EP99/01655

§ 371 Date: Nov. 17, 1999

§ 102(e) Date: Nov. 17, 1999

(87) PCT Pub. No.: WO99/48784

PCT Pub. Date: Sep. 30, 1999

(30) Foreign Application Priority Data

Mar. 20, 1998 (DE) ..... 298 04 960 U

(51) Int. Cl.[7] ..... B65G 1/133

(52) U.S. Cl. ..... 414/751.1; 414/22.63; 414/331.06; 414/752.1; 198/340; 198/341.01; 209/534; 209/546

(58) Field of Search ..... 209/534, 546; 414/22.63, 331.06, 751.1, 752.2; 198/340, 341.01

(56) References Cited

U.S. PATENT DOCUMENTS 4,362,461 * 12/1982 Cathers ..... 414/752
5,628,574 * 5/1997 Crowley ..... 400/621
5,664,026 9/1997 Neri et al. .

FOREIGN PATENT DOCUMENTS 23 29 041 A1 1/1975 (DE) .
39 42 932 A1 6/1991 (DE) .
0 810 092 A1 * 12/1997 (IT) ..... B41F/33/00

OTHER PUBLICATIONS

"Printed Circuit Board Through–Hole Inspection Using Video Camera" In: IBM Technical Disclosure Bulletin, vol. 30, No. 3, Aug. 1997, S. 980, S. 981.

JP 6–183638 A., In: Patent Abstracts of Japan, M–1684, Oct. 6, 1994, vol. 18, No. 529.

JP 6–183638 (A), Patent Abstracts of Japan, M–1684, Oct. 6, 1994, vol. 18, No. 529.

IBM Technical Disclosure Bulletin, vol. 30, No. 3, pp. 980–981.

* cited by examiner

*Primary Examiner*—Donald Walsh
*Assistant Examiner*—Mark J. Beauchaine
(74) *Attorney, Agent, or Firm*—Larson & Taylor PLC

(57) ABSTRACT

A device is provided for monitoring sheets from which cards with a monetary value and/or identity cards are punched, where the cards are arranged in rows on the sheets. The device is configured such that the number of cameras used is independent of the number of rows of cards. The device has a table on which at least two sheets can be laid. A camera can be moved along and across the table, and a conveyor device travels along the table above the camera.

8 Claims, 1 Drawing Sheet

DEVICE FOR MONITORING SHEETS

FIELD OF THE INVENTION

The invention concerns a device for monitoring sheets from which value cards and/or personal cards are punched out, where the cards are arranged in rows on the sheets.

BACKGROUND OF THE INVENTION

It is known to transfer the single sheets to a conveyor belt above which an electronic camera is provided for each row of cards. The cameras are connected with a computer which has a comparator circuit which compares the camera images with a criteria catalogue.

Sheets which have defective cards are sorted out, while sheets having flawless cards are conveyed for further processing.

If, for example, a sheet has eight rows of cards, then eight cameras are required for this monitoring device. However, cameras with a corresponding resolution are very expensive. A further disadvantage of the known device can be seen therein that sheets having only a few defective cards can also be rejected.

BRIEF SUMMARY OF THE INVENTION

The object is to design the monitoring device in such a way that the number of cameras used is independent of the number of card rows.

This object is solved with the features of the device of the present invention. The device includes a longitudinal table on which at least two sheets are deposited, at least one camera which is mounted to travel longitudinally and transversely to the table, and a conveying device for the sheets that can travel above and along the table and up to above a feed station and a transfer station.

BRIEF DESCRIPTION OF THE DRAWINGS

An example of an embodiment will be described in greater detail in the following with reference to the single FIGURE of the drawing which shows a perspective view of the monitoring device.

DETAILED DESCRIPTION OF THE INVENTION

Figure 1:
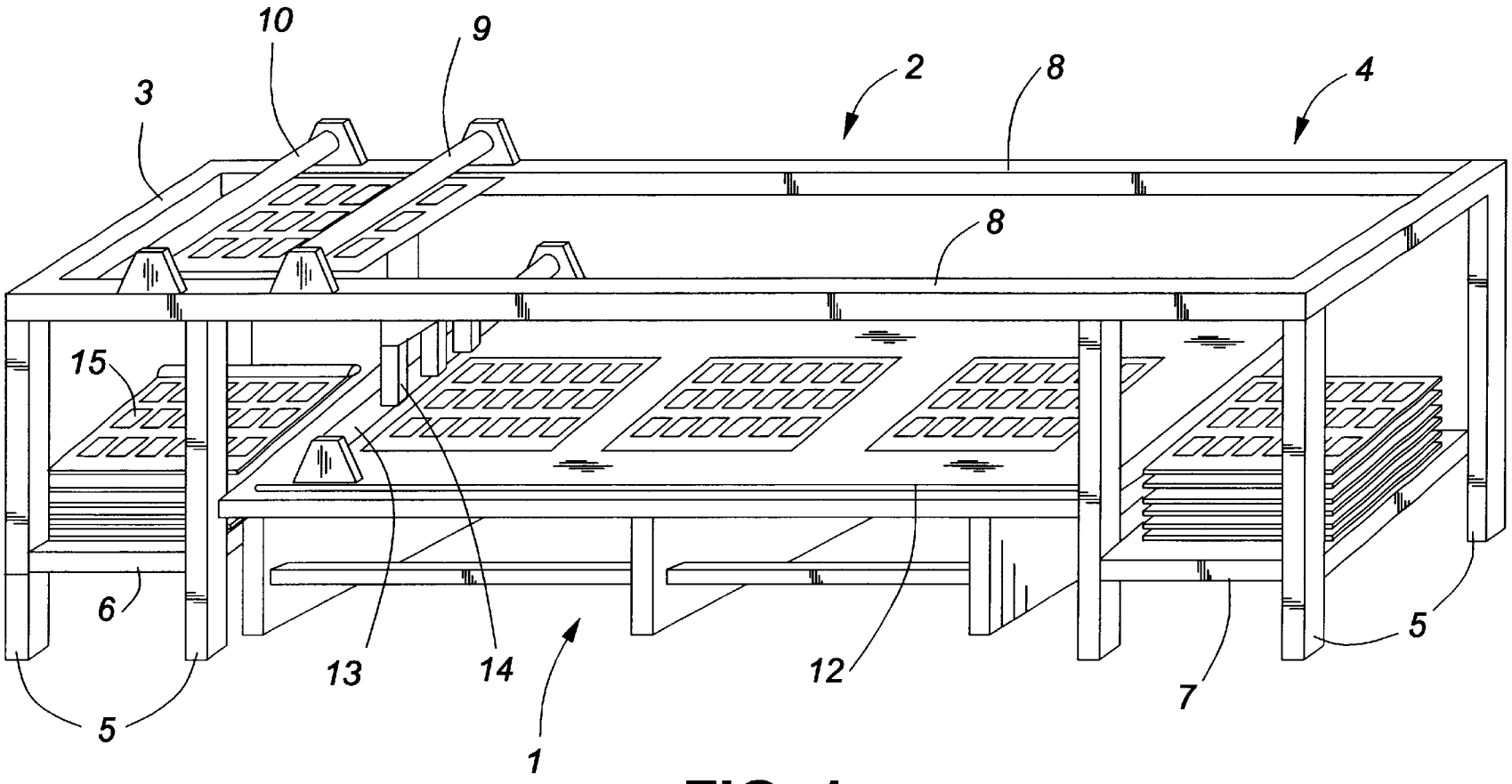

The monitoring device has a longish table 1 above which a longish rack 2 is disposed. A feed station 3 is provided on one end of the table, while a transfer station 4 is provided on the other end. The rack 2 extends over both these stations 3, 4 and has four support legs 5 each there between which a transport vehicle 6, 7 can be inserted in each case.

A conveying device 9 can travel along the longitudinal girder 8 of the rack 2, said conveying device consisting of a rectangular frame having the crosspieces 10 on which two telescopic suction cups 11 each are arranged.

Guide rails 12 extending in longitudinal direction, along which rails 10 a sliding carriage 13 can travel, are provided on the table 1. The sliding carriage 13 is therefore aligned transversely to the longitudinal axis of the table. This sliding carriage 13 has a guide which is aligned transversely to the longitudinal axis of the table 1. This guide has at least one electronic camera 14. A marking device is allocated to each electronic camera 14.

In operation, the transport vehicle 6 initially has a stack of sheets 15 to be monitored. This transport vehicle 6 is then inserted into the feed station 3. The suction cups 11 of conveying device 9 are next operated to take hold of the uppermost sheet 15, whereby the conveying device 9 then travels along the longitudinal girder 8 and transfers this sheet to the table surface. In the embodiment shown, three sheets are placed in succession on the table top. The camera 14 on carriage 13 then preferably scans the sheet deposited first. This scanning can take place by the row in the longitudinal (X) direction or by the line in the transverse (Y) direction. When scanning takes place in longitudinal (X) direction, the sliding carriage 13 travels; while when scanning takes place in the transverse (Y) direction, the camera 14 travels instead along the sliding carriage 13. Once a row or line has been scanned, the next row or line is scanned. If an error is detected during scanning, the marking device is actuated which marks the defective value card and/or personal card as defective. Thereafter a scanned sheet is again taken up by the suction cups 11 and transferred to the transfer station 4. The scanned sheet is then replaced by a new sheet, while the next sheet is scanned by the camera 14.

What is claimed is:

1. A device for monitoring sheets from which value cards and/or personal cards are punched out, where the cards are arranged in rows on the sheets, the device comprising:

a longitudinal table on which at least two sheets are deposited, at least one camera which is mounted to travel longitudinally and transversely to the table, and a conveying device for the sheets that can travel above and along the table and up to above a feed station and a transfer station.

2. A device according to claim 1, wherein the feed station is arranged on one end of the table and the transfer station on the other end of the table.

3. A device according to claim 1, and further including a marking device associated with the at least one camera.

4. A device according to claim 1, wherein a length of the table is such that at least three sheets can be deposited therealong.

5. A device according to claim 1, wherein the at least one camera is arranged on a sliding carriage which said carriage can travel along the table, and hence the at least one camera can travel along with the sliding carriage.

6. A device according to claim 1, wherein the conveying device can travel along a rack overlapping the table.

7. A device according to claim 6, wherein the rack overlaps the feed and transfer stations and has support legs at these stations between each of which a transport vehicle can be inserted.

8. A device according to claim 1, wherein the conveying device has a rectangular frame, the rectangular frame including crosspieces on which telescopic suction cups are arranged.

* * * * *